US008888599B2

(12) United States Patent
Terry

(10) Patent No.: US 8,888,599 B2
(45) Date of Patent: Nov. 18, 2014

(54) GAMING TERMINAL HAVING A PRIZE FULFILLMENT MECHANISM

(75) Inventor: Richard Terry, Stafford (GB)

(73) Assignee: Megatouch, LLC, Bristol, PA (US)

( * ) Notice: Subject to any disclaimer, the term of this patent is extended or adjusted under 35 U.S.C. 154(b) by 0 days.

(21) Appl. No.: 13/292,635

(22) Filed: Nov. 9, 2011

(65) Prior Publication Data

US 2012/0122562 A1 May 17, 2012

(30) Foreign Application Priority Data

Nov. 11, 2010 (GB) ..... 1019085.8

(51) Int. Cl.
*A63F 9/24* (2006.01)

(52) U.S. Cl.
USPC ..... 463/42; 463/20

(58) Field of Classification Search
None
See application file for complete search history.

(56) References Cited

U.S. PATENT DOCUMENTS

| | | | | |
|---|---|---|---|---|
| 5,083,271 | A | 1/1992 | Thacher et al. | |
| 5,711,715 | A | 1/1998 | Ringo et al. | |
| 6,908,390 | B2 | 6/2005 | Nguyen et al. | |
| 7,070,506 | B1 | 7/2006 | Ropp et al. | |
| 7,094,154 | B2 | 8/2006 | Kellerman et al. | |
| 7,156,739 | B2 | 1/2007 | Walker et al. | |
| 7,684,882 | B2 | 3/2010 | Baerlocher et al. | |
| 7,690,996 | B2 | 4/2010 | Iddings et al. | |
| 7,798,901 | B2 | 9/2010 | Nguyen et al. | |
| 7,967,681 | B2 | 6/2011 | Ropp et al. | |
| 2002/0115488 | A1 * | 8/2002 | Berry et al. | 463/42 |
| 2003/0130032 | A1 * | 7/2003 | Martinek et al. | 463/29 |
| 2005/0071024 | A1 | 3/2005 | Henshaw | |
| 2007/0026922 | A1 * | 2/2007 | Lindo et al. | 463/16 |
| 2007/0060258 | A1 * | 3/2007 | Duhamel | 463/16 |
| 2008/0167117 | A1 | 7/2008 | Moshal et al. | |
| 2008/0254893 | A1 | 10/2008 | Patel et al. | |
| 2009/0131175 | A1 | 5/2009 | Kelly et al. | |
| 2009/0197659 | A1 * | 8/2009 | Christensen | 463/16 |
| 2009/0275374 | A1 | 11/2009 | Nelson et al. | |
| 2009/0280904 | A1 | 11/2009 | Nicely et al. | |
| 2010/0113162 | A1 | 5/2010 | Vemuri et al. | |

(Continued)

FOREIGN PATENT DOCUMENTS

WO 9412256 A1 6/1994

OTHER PUBLICATIONS

Examination Opinion issued Mar. 11, 2011 by the United Kingdom Intellectrual Property Office in related UK Patent Application No. GB1019085.8.

(Continued)

*Primary Examiner* — Masud Ahmed
(74) *Attorney, Agent, or Firm* — Panitch Schwarze Belisario & Nadel LLP

(57) ABSTRACT

A gaming terminal is configured to permit each player of a plurality of players to play a game in a tournament. The gaming terminal includes a processor configured to specify the maximum number of games which may be played in the tournament, count the number of games which have been played by each player, and verify the identity of a winning player. The gaming terminal also includes a prize fulfillment mechanism configured to pay out a cash prize to the winning player. The prize fulfillment mechanism pays out the cash prize instantly and directly to the winning player upon verification of the winning player's identity and when the number of games played equals the maximum number of games which may be played in the tournament.

20 Claims, 4 Drawing Sheets

(56) References Cited

U.S. PATENT DOCUMENTS

| | | | |
|---|---|---|---|
| 2010/0151938 | A1 | 6/2010 | Boesen |
| 2010/0240443 | A1 | 9/2010 | Baerlocher et al. |
| 2010/0304825 | A1 | 12/2010 | Davis et al. |
| 2011/0039610 | A1 | 2/2011 | Baerlocher et al. |
| 2011/0117981 | A1 | 5/2011 | Baerlocher et al. |
| 2011/0130186 | A1 | 6/2011 | Chim |

OTHER PUBLICATIONS

Int'l Search Report issued Mar. 29, 2012 in Int'l Application No. PCT/US11/60086; Written Opinion.

* cited by examiner

GAMING TERMINAL HAVING A PRIZE FULFILLMENT MECHANISM

BACKGROUND OF THE INVENTION

Embodiments of the present invention relate to gaming terminals, and in particular to multiplayer tournaments played via offline gaming machines known as "Skill with Prize" terminals.

"Skill with Prize" (SWP) terminals are commonly found in public places (such as public houses, bars, cafes, restaurants, casinos, canteens, waiting rooms, or the like) and traditionally run a mix of "instant payout" games such as pub quizzes, simulated darts leagues, "Spot the Difference" challenges and so on. Players pay to play against a computer program running on a processor within the terminal in an attempt to win an instant cash prize based on their ability to answer trivia questions or demonstrate manual dexterity, observation skills, or the like. The cash prize is paid out instantly by the gaming terminal to the winning player.

Another software application that currently runs on this type of gaming machine is "tournament play," where instead of playing against a computer program, players compete against each other in a high-score league format over a predetermined amount of time (e.g. one month, one week, or the like). These tournaments operate with a predetermined prize fund and prize award structure. Thus, such multiplayer tournaments offer players the opportunity to play against each other for increased prizes until the tournament ends.

Tournaments may be conducted in real time or may be turn-based, and may or may not be connected to an on-line network. Typically, a tournament includes a single type of game or challenge (e.g. Solitaire) where players' scores are placed on a "leader board." Once the (time-based) tournament ends, all scores on this leader board are collated and the winner is paid out.

For SWP terminals which are not connected to an online network, a terminal operator sets up a tournament event on a single offline gaming terminal so that only players in that location (e.g., a particular pub) may compete. Players visiting that location use the offline terminal to play against one another on a score-matching system within a pre-determined timescale. Such tournaments are known as "local tournaments" with prizes traditionally varying between approximately $5.00 and $160.00 depending upon game throughput within the overall duration of the tournament.

In order to obtain the prize, the winner may have to undergo a claim process. Prize payout is typically performed by check or by electronic transfer of funds (e.g. by PayPal or similar facility). In the case of smaller cash wins, the retailer or location manager may pay out the prize to the winner.

When an operator sets up a local tournament on a terminal he must input the start and end dates for each individual event and also often "seeds" the prize pool with an introductory amount (typically $8.00). Ongoing tournament games (typically at $1.60 per play) then further increment this potential prize pool at a rate that is configurable between 10 to 50% of the price of play. For example, if the operator "seeds" the prize pool with $8.00 and then sets the incremental rate at 20% and the price of play at $1.60, after no games (entries) have been played the prize pool will stand at $8.00; after one game it will be $8.30; after 10 games it will be $11.20 and so on through the fixed duration of the individual tournament event.

All participating players must pre-register a chosen username, provide their mobile telephone number and select a unique PIN (Personal Identification Number). When each tournament is complete, a final "league table" is published on the terminal's screen and a prize winner is able to claim his prize by asking the manager (often the landlord) of the location to use his/her non-public PIN to access a claim screen where the player can input his player PIN number to prove that he is a bona fide winner. Once the identity of the winner has been verified via the claims process, the cash prize is paid to the winner by the personnel at the location (e.g., by the pub landlord from the till). When the terminal's cash takings are subsequently reconciled and collected by the machine operator (usually every 14 days or so) the location personnel are reimbursed for the prizes they have paid out. The next local tournament event is then manually configured by the machine operator.

However, there are numerous disadvantages associated with known local tournament systems. For example, local tournaments can only be set over a specified time period. The terminal operator must therefore attempt to "guess" the popularity of any chosen tournament game when "seeding" the prize pool. If the event is "seeded" with $8.00 and only one player takes part at $2.60 per entry then that player is guaranteed to win $8.30, leaving the terminal in deficit by $4.10. If the operator places no "seed" in the prize pool, then the initial $0.00 prize on offer to players offers no encouragement to play.

Another disadvantage is that prize fulfillment requires ongoing involvement from location staff/management. Many public house licensees, managers or landlords do not want the inconvenience of the process of accessing claim screens, supervising players entering PIN numbers and then fulfilling cash prizes from their "own pocket" and awaiting reimbursement by the terminal operator.

A further disadvantage is that players frequently become disillusioned with participating in local tournament play, particularly away from their own "local" locations. The claiming of prizes can be awkward, junior location staff may not have access to the terminals, or the like. This is not a problem if the location is "local" to players, but it discourages play elsewhere and therefore restricts growth of the opportunity.

Another form of tournament experience is that of online (i.e. internet-based) tournaments which players use via a website using an internet-connected computer. To date, tournaments in the "physical" SWP terminal world have always been time-based. However, in the online sector, "high-score" tournaments based on a fixed number of games (entries) are offered via web sites. These tournament events are designed to conclude when a pre-determined number (e.g., 2, 4, 8, 16, 32, 64, or the like) of individual games has been played. However, such online/internet events and games all operate on the basis of player accounts. Prior to competing, each player must create a funding account from which entries are paid and/or into which prizes are fulfilled. Prizes are fulfilled using these accounts or by electronic transfer (using PayPal or the like) or even by posting checks in the mail. Thus, there is no possibility of an instant cash payout made directly to the winner from such sites, and the winner still has to either wait for his check to arrive in the post or transfer finds electronically from his gaming account into a bank account in order to access the funds.

An improved system has now been devised.

BRIEF SUMMARY OF THE INVENTION

A preferred embodiment of the present invention relates to a gaming terminal configured to permit each player of a plurality of players to play a game in a tournament. The gaming terminal includes a processor configured to specify the maximum number of games which may be played in the tournament, count the number of games which have been played by each player, and verify the identity of a winning player. The gaming terminal also includes a prize fulfillment mechanism configured to pay out a cash prize to the winning player. The prize fulfillment mechanism pays out the cash prize instantly and directly to the winning player upon verification of the winning player's identity and when the number of games played equals the maximum number of games which may be played in the tournament Another preferred embodiment of the present invention relates to a method of managing a tournament of individual games played on a gaming terminal having a processor by a plurality of players. The method includes: i) setting, by the processor, the maximum number of games which may be played in the tournament, ii) counting, by the processor, the number of games which have been played in the tournament, iii) verifying, by the processor, the identity of a winning player, and iv) paying out a cash prize instantly and directly to the winning player, by a prize fulfillment mechanism, upon verification of the winning player's identity and when the number of games played equals the maximum number of games which may be played in the tournament.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
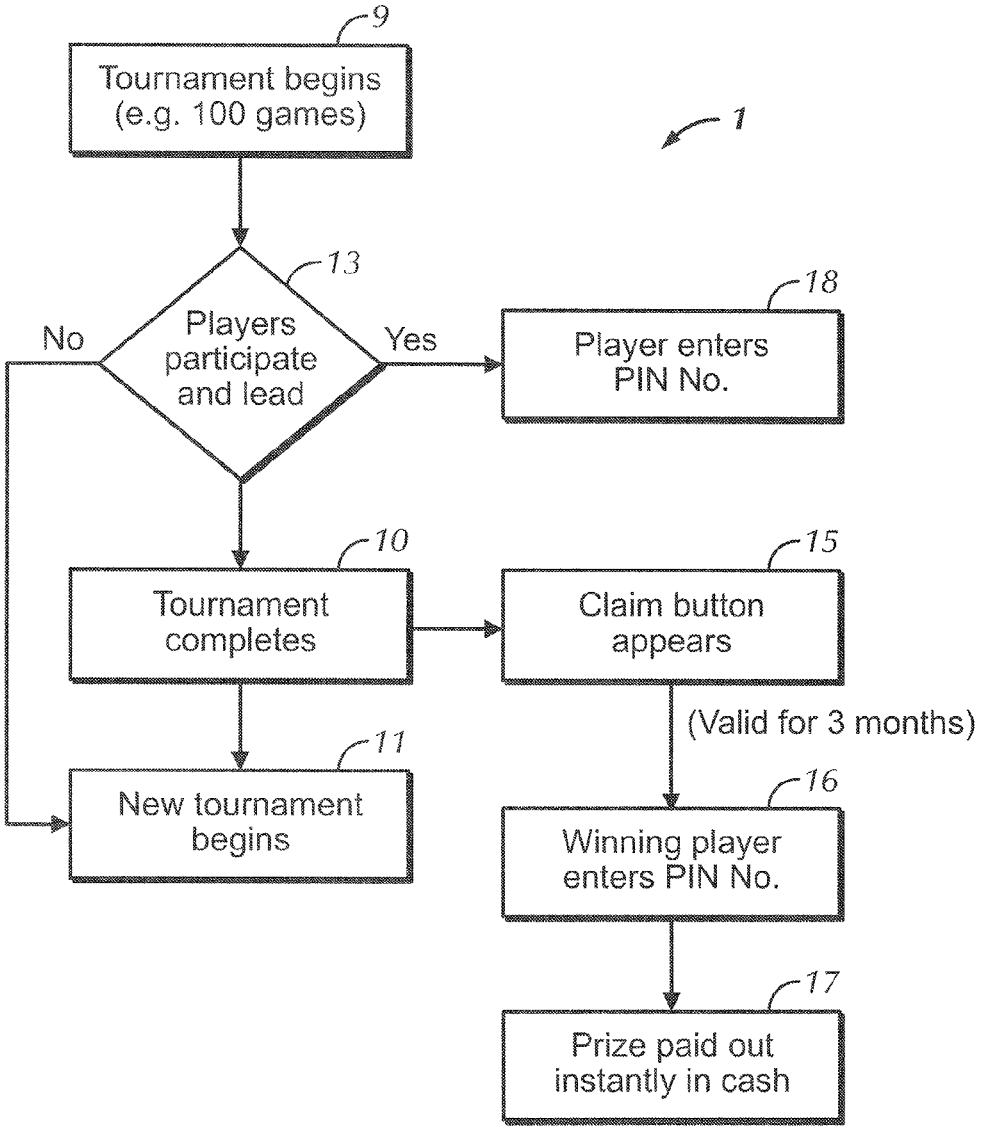
FIG. 1 is a flowchart illustrating at high-level the steps taking when using an embodiment of the invention.

Certain terminology is used in the following description for convenience only and is not limiting. The words "right," "left," "lower," and "upper" designate directions in the drawings to which reference is made. The words "inwardly" or "distally" and "outwardly" or "proximally" refer to directions toward and away from, respectively, the geometric center or orientation of the device and instruments and related parts thereof. The terminology includes the above-listed words, derivatives thereof and words of similar import.

Thus, in accordance with embodiments of the present invention, there is provided a gaming terminal configured to permit each of a plurality of players to play a game in a tournament, the terminal includes a mechanism configured to count the number of games which have been played; a mechanism configured to specify the maximum number of games which may be played in the tournament; a verification mechanism configured to verify the identity of a winning player; and a prize fulfillment mechanism configured to pay out a cash prize to the winning player. The prize fulfillment mechanism pays out the cash prize instantly and directly to the winning player upon verification of the winning player's identity and when the number of games played equals the maximum number of games which may be played in the tournament.

The term "cash prize" is used herein to refer to a physical prize which may be dispensed by mechanical means to the player in a tangible (non-electronic) form. Thus, the term "cash prize" includes coins, bank notes and tokens.

The terms "instantly" is used herein to mean that the prize is dispensed immediately to the player upon verification of his identity at the end of the tournament without, for example, having to undergo a claims process, and without delay. The skilled addressee would understand the phrase "instant payout" to mean that the prize is dispensed without further delay or intervening actions.

The term "directly" is used herein to mean that the prize is paid to the player from the terminal, and no other individual or device needs to be involved in the process of prize fulfillment.

Preferably, the gaming machine or "terminal" according to embodiments of the present invention is an offline gaming machine or terminal. The term "offline terminal" is used herein to refer to a gaming machine upon which a game or challenge may be played and which may or may not be connected to the interne, and is used in isolation at a given physical location. Thus, the term "offline gaming terminal" excludes tournament (and other gaming) applications presented or executed via a web site.

Similarly, the term "offline tournament" is used herein to refer to a tournament of individual games in which players compete against each other in sequence using a gaming machine (terminal) which does not need to be connected to the internet.

Preferably, the gaming terminal is an offline SWP machine. SWP machines are generally known, and it will be known to one skilled in the art that such machines typically include a storage area configured to store data, and a computer processor configured to execute application software.

Preferably, the cash prize is paid out directly to the winning player at the end of the tournament without the need for location personnel to verify the winning player's identity or for the player to undergo a claims process which involves input from another person. Thus, embodiments of the present invention provide a self-sufficient terminal.

Preferably, the gaming terminal further includes a mechanism configured to store the score earned by each of the plurality of players at the end of each game.

Preferably, at the end of each game, the score is stored in association with a unique player identifier.

Preferably, the unique identifier is a number, code, password or alphanumeric combination chosen by the player and stored within the terminal upon the player's entry to the tournament.

Preferably, the verification mechanism is arranged and configured to compare a player identifier entered into the terminal against a unique player identifier previously stored in the terminal and associated with the winning score.

Preferably, the scores are sorted and/or displayed on a screen in ascending or descending order.

Preferably, the terminal further includes a volatile and/or non-volatile storage device for storing the number of games played, the maximum number of games which may be played in the tournament, the individual game scores earned by the plurality of players during the tournament, and/or a unique code, number or password associated with each of the plurality of players.

Preferably, the terminal includes a touch screen for the presentation and input of information.

Preferably, the prize fulfillment mechanism is a mechanical device for dispensing coins, tokens and/or bank notes.

Preferably, the verification mechanism is arranged and configured to permit verification of the identity of a winning player of the tournament for a fixed period of time.

Preferably, the terminal further includes a mechanical mechanism configured to receive a cash entry fee from a player to permit the player to enter the tournament.

Preferably, the terminal is arranged and configured to permit a player to claim a prize for a tournament selected from a list of tournaments.

Preferably, a guaranteed prize value is presented to each of the plurality of players prior to entering the tournament.

Preferably, the un-played number of games remaining in the tournament is displayed on a screen.

Also, in accordance with embodiments of the present invention, there is provided a method of managing a tournament of individual games played on a gaming terminal by a plurality of players. The method includes i) setting the maximum number of games which may be played in the tournament; ii) counting the number of games which have been played in the tournament; iii) verifying the identity of a winning player; and iv) paying out a cash prize instantly and directly to the winning player upon verification of the winning player's identity and when the number of games played equals the maximum number of games which may be played in the tournament.

Preferably, the gaming terminal is an offline (not web-based) device.

Also preferably, the tournament is an off-line tournament not conducted via, including or using a web site.

The cash prize is a physical, tangible prize which is not paid to the player in an electronic form, and preferably is in the form of coins, tokens and/or bank notes.

Preferably, verification of the winning player's identity includes comparing a player identifier entered into the terminal against a unique player identifier previously stored in the terminal and associated with the winning score.

The flowchart of FIG. 1 shows, at high level, the concept behind embodiments of the present invention 1. The remaining Figures show illustrative screen shots of an exemplary embodiment of the invention on which an "Instant Darts Tournament" can be executed.

The apparatus of the preferred embodiment comprises a SWP gaming terminal which is arranged and configured to permit players to compete against each other in an offline tournament, in which players complete tasks or play a chosen game in the hope of winning a cash prize. The game and/or tournament is not web/internet based.

The exemplary "Instant Darts Tournament" application is arranged and configured by the terminal operator to run over a fixed duration of 100 played games (see step 9, FIG. 1) although any number of games may be used as the tournament limit.

Upon completion of the 100th game (see step 10, FIG. 1), that individual tournament "event" is automatically finished and the player in first position on the on-screen "leader board" is the winner, and a new tournament begins, as represented by step 11 in FIG. 1. This fixed duration (number of games) can be set over any number of individual games and can also be pre-set to pay more prizes than just to the outright leader. For example, a prize may also be awarded to the runner-up (i.e., the player with the next highest score) or players in second or third place.

In this example, the price of playing a single game (entry) is set at 50¢. Therefore, the terminal "knows" that 100 games×50¢ play will equal a total gross revenue of $50.00, allowing direct payment of the pre-set prize pool of $25.00 and (shared) net earnings to the operator/location at $25.00.

There is no requirement for any time limit to each individual tournament event as each event lasts for a pre-determined number of games (entries). In a busy location, 100 games may only take a few days to play. In a quiet location, 100 games may take several weeks to complete. The terminal does not "recognize" (or need to recognize) this passage of time as it "knows" it will only ever return 50% takings to winners.

Figure 2:
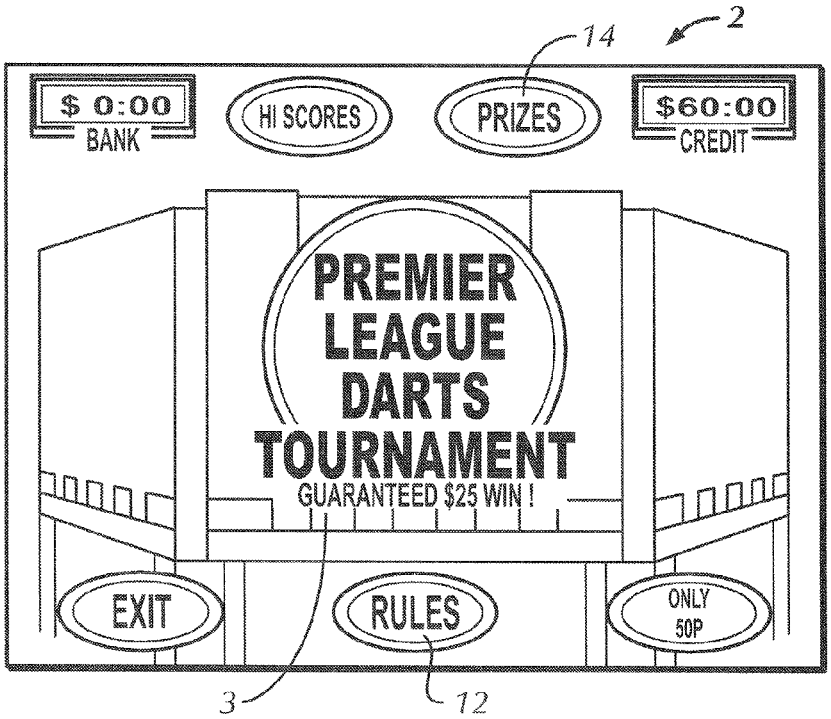
FIG. 2 shows an "Opening Menu" screen in accordance with an embodiment of the present invention.

The gaming terminal can thus advertise a "Guaranteed $25.00 Win" to players before they commit any money to entice them into the tournament (see reference 3 in FIG. 2). Also, the number of games remaining in each "Instant Tournament" can be displayed on the terminal screen (as shown as reference 8 in FIG. 6).

Prior to entering the tournament, an opening menu 2 is displayed on the terminal screen as shown in FIG. 2. This may include a "Rules" button 12 which may cause a list of tournament rules to be displayed or any other additional features which the operator desires to be displayed.

Figure 3:
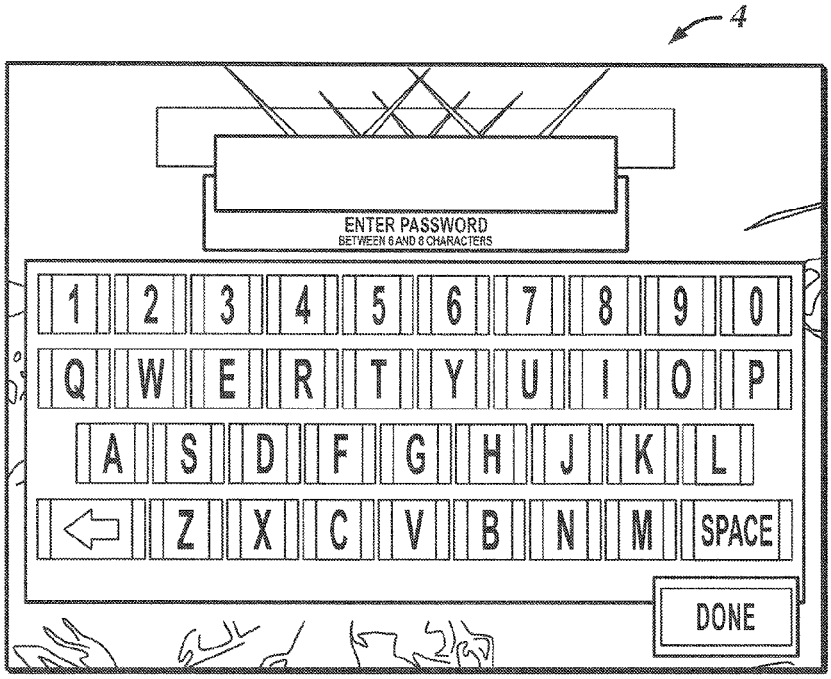
FIG. 3 shows a "Password Entry" screen in accordance with an embodiment of the present invention.

When a player decides to enter the tournament (i.e., wants to play a game), he pays his entry money into the slot provided on the terminal. The player is prompted to enter a PIN, password or other unique identifying code which will then be stored within the terminal for subsequent access, as represented by step 18 in FIG. 1. Thus, the identity of the player can be verified later at step 16 of FIG. 1. The Password Entry screen 4 is shown in FIG. 3.

Having entered the tournament, the player plays his individual game, as represented by step 13 in FIG. 1.

When the player's game ends, his score is compared with that of previously earned scores to determine whether or not the player has won, and/or where in the leader board the score should be placed. If the player has earned the highest score so far in the tournament, his score is added to the first position in the Leader Board.

Figure 6:
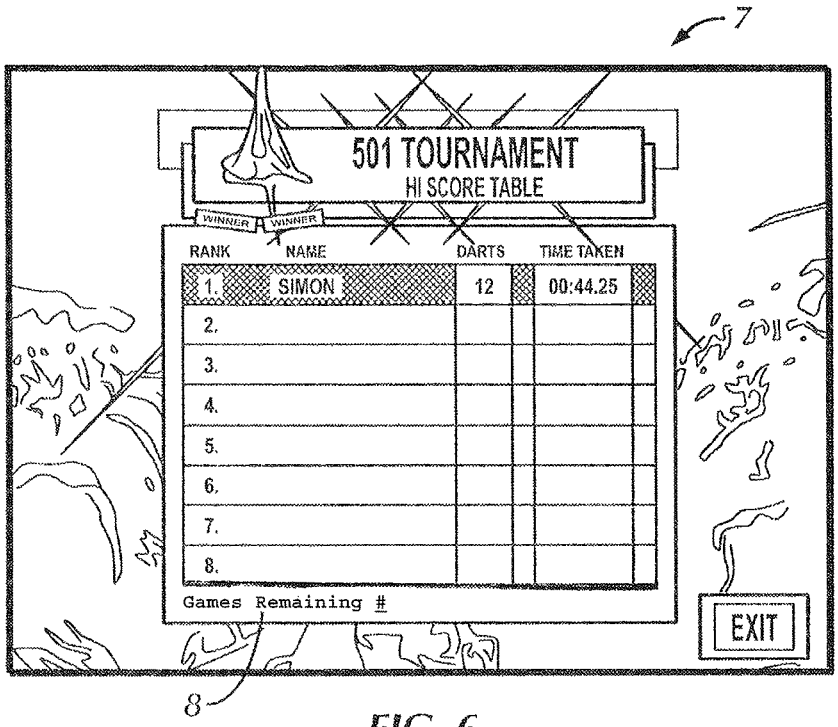
FIG. 6 shows a "leader board/games remaining" screen in accordance with an embodiment of the present invention.

This process repeats, player by player with each new game score being compared to previously earned and stored scores, and then being displayed on the leader board in the appropriate position at the end of each game. The Leader Board 7 is shown in FIG. 6 and includes an indication to the player as to the number of games left 8 in the tournament.

Once each "Instant Tournament" is complete, as represented by step 10 in FIG. 1, a "PRIZES" icon 14 appears on the terminal screen, as represented by step 15 in FIG. 1, and another "Instant Tournament" instantly begins, as represented by step 11 in FIG. 1. The "Prizes" icon 14 will remain on the screen for a fixed period of time (e.g., 3 months).

Figure 4:
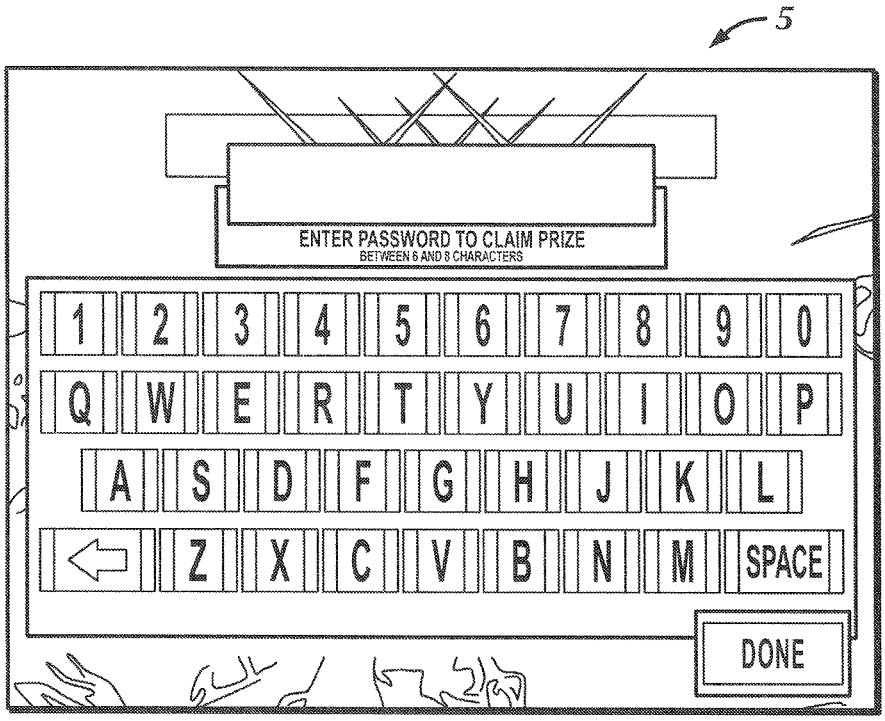
FIG. 4 shows a "Player Claim" screen in accordance with an embodiment of the present invention.
Figure 5:
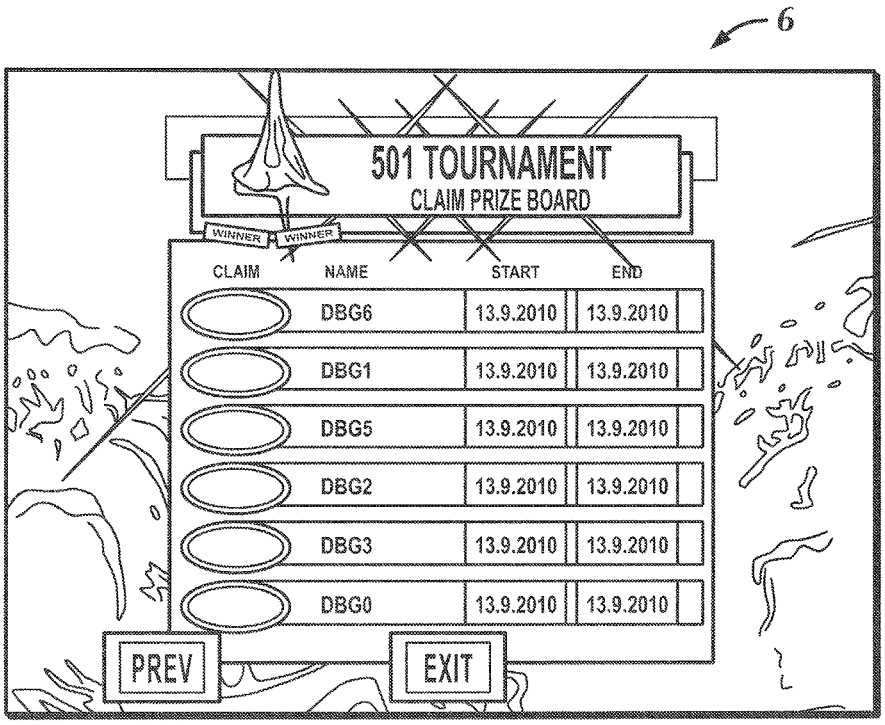
FIG. 5 shows a "finished tournament" claims screen in accordance with an embodiment of the present invention.

Upon pressing the "PRIZES" icon or button 14, a "finished tournament claims" screen 6 is displayed as shown in FIG. 5, showing the player a list of concluded tournaments for which prizes may be claimed. To claim a prize for a particular tournament, the player clicks on the "claim" icon for that tournament and is then presented with a password entry screen 5 as shown in FIG. 4.

The user can then enter his unique password (which he chose when he first entered) to claim his prize, as represented by step 16 in FIG. 1. The application compares the entered password with those stored in memory to verify that the player is the winner of the tournament event. If a match is found (i.e., the winner's password has been entered), the machine's internal "Bank" will immediately credit the player with $25.00 which can be instantly collected directly from the terminal in any form of currency, preferably $1.00 or $5.00 coins or bills, as represented by step 17 in FIG. 1. Coin handling and mechanical payout functions are known within the art and are not within the scope of the present invention.

Thus, numerous advantages are provided by embodiments of the present invention, which provides a SWP tournament terminal which is self-sufficient, self-managing and self-funding.

Embodiments of the present invention provide the advantages of the three known prior art arrangements while providing a solution to the disadvantages of the known arrangements (i.e., avoids the claims process and fixed timescale of local tournament systems; provides the tournament experience lacking with SWP terminals; and provides the instant cash pay outs not known or possible with online tournaments).

Other advantages provided by the present invention include:

Equipment operators do not need to "guess" game popularity when selecting a game to run as a tournament event. Indeed, equipment operators do not have to do anything at all; the entire tournament event is self-sufficient and self-funded.

Location owners/managers/staff do not need to take time interacting with customers in order to verify and fulfill prizes. The entire administration and cash handling function is removed.

Players are able to play a tournament secure in the knowledge that as soon as each individual tournament ends, they can receive any cash prize due to them "instantly" without the need for any interaction with location staff. This has an added hidden benefit to intuitive players in that if they go to the top of a Leader Board on Game 93, for example, they simply can play out the remaining seven games themselves in order to guarantee finishing the event in $1^{st}$ position.

Embodiments of the invention may be implemented by way of hardware including several distinct elements, and by way of a suitably programmed computer. In a device claim enumerating several mechanisms, several of these mechanisms may be embodied by one and the same item of hardware, such as the processor of the gaming terminal or other processor, computer, server, or the like. The mere fact that certain measures are recited in mutually different dependent claims does not indicate that a combination of these measures cannot be used to advantage.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A gaming terminal configured to permit a plurality of players to play a game in a tournament, the offline tournament being played only on the single gaming terminal by the plurality of players, the single gaming terminal comprising:

a processor configured to: (i) specify the maximum number of games which may be played in the tournament; (ii) count the number of games which have been played by the plurality of players; (iii) determine a winning score by comparing scores earned by the plurality of players; and (iv) after the plurality of players have played the game on the single gaming terminal and when the number of games played equals the maximum number of games which may be played in the offline tournament, verify the identity of a winning player by comparing a player identifier entered into the single gaming terminal against a unique player identifier previously stored in the single gaming terminal and associated with the winning score; and a prize fulfillment mechanism configured to pay out a cash prize to the winning player, the prize fulfillment mechanism paying out the cash prize instantly and directly to the winning player upon verification of the winning player's identity.

2. The gaming terminal according to claim 1, wherein the gaming terminal is an offline terminal and/or a skill with prize machine.

3. The gaming terminal according to claim 1 further comprising a storage mechanism configured to store a score earned by each player of the plurality of players at the end of each game.

4. The gaming terminal according to claim 3, wherein, at the end of each game, the score earned by each player of the plurality of players is stored in association with a unique player identifier.

5. The gaming terminal according to claim 4, wherein the unique identifier is one of a number, a code, a password and an alphanumeric combination, the unique identifier being chosen by the player and stored within the terminal upon the player's entry in the offline tournament.

6. The gaming terminal according to claim 1, further comprising a verification mechanism arranged and configured to compare a player identifier entered into the terminal against a unique player identifier previously stored in the terminal and associated with a winning score.

7. The gaming terminal according to claim 3, wherein the scores are sorted and/or displayed on a screen in ascending or descending order.

8. The gaming terminal according to claim 1, wherein the terminal comprises a volatile and/or a non-volatile storage device configured to store at least one of the number of games played, the maximum number of games which may be played in the offline tournament, a score earned by each player of the plurality of players during the offline tournament, and a unique code, number or password associated with each player of the plurality of players.

9. The gaming terminal according to claim 1 further comprising a touch screen for the presentation and input of information.

10. The gaming terminal according to claim 1, wherein the prize fulfillment mechanism comprises a mechanical device configured to dispense coins or bank notes.

11. The gaming terminal according to claim 1, wherein the processor is arranged and configured to permit verification of the identity of a winning player of the offline tournament for a fixed period of time.

12. The gaming terminal according to claim 1 further comprising an input mechanism configured to receive a cash entry fee from a player to permit the player to enter the offline tournament.

13. The gaming terminal according to claim 1, wherein the terminal is configured to permit a player to claim a prize for a offline tournament selected from a list of tournaments.

14. The gaming terminal according to claim 1, wherein a guaranteed prize value is presented to each player of the plurality of players prior to entering the offline tournament.

15. The gaming terminal according to claim 1, wherein a number of games which remain unplayed in the offline tournament is displayed on a screen.

16. A method of managing an offline tournament of individual games played only on a gaming terminal having a processor by a plurality of players, the method comprising: i) setting, by the processor, the maximum number of games which may be played in the offline tournament; ii) counting, by the processor, the number of games which have been played in the offline tournament; iii) determining, by the processor, a winning score by comparing scores earned by the plurality of players; iv) after the plurality of players have played the games on the single gaming terminal and when the number of games played equals the maximum number of games which may be played in the offline tournament, verifying, by the processor, the identity of a winning player by comparing a player identifier entered into the single gaming terminal against a unique player identifier previously stored in the single gaming terminal and associated with the winning score; and v) paying out a cash prize instantly and directly to the winning player, by a prize fulfillment mechanism, upon verification of the winning player's identity.

17. The method of managing an offline tournament of individual games according to claim 16, wherein the cash prize comprises coins and/or bank notes.

18. The method of managing an offline tournament of individual games according to claim 16, wherein verification of the winning player's identity comprises comparing a player identifier entered into the terminal against a unique player identifier previously stored in the terminal and associated with the winning score.

19. A method of managing an offline tournament of individual games according to claim 16, wherein the terminal is an offline skill with prize machine.

20. An offline gaming terminal configured to permit a plurality of players to play a game in an offline tournament, the game being played by the plurality of players only on the offline gaming terminal, the offline gaming terminal comprising: a processor configured to: (i) specify the maximum number of games which may be played in the offline tournament; (ii) count the number of games which have been played by the plurality of players; (iii) determine a winning score by comparing scores earned by the plurality of players; and (iv) after the plurality of players have played the game on the offline gaming terminal and when the number of games played equals the maximum number of games which may be played in the offline tournament, verify the identity of a winning player by comparing a player identifier entered into the offline gaming terminal against a unique player identifier previously stored in the offline gaming terminal and associated with the winning score; and a prize fulfillment mechanism configured to pay out a cash prize to the winning player, the prize fulfillment mechanism paying out the cash prize instantly and directly to the winning player upon verification of the winning player's identity.

* * * * *